United States Patent [19]

Fuehrer

[11] Patent Number: 5,052,081

[45] Date of Patent: Oct. 1, 1991

[54] CLIP ASSEMBLY FOR BADGES AND SIMILAR ARTICLES

[75] Inventor: Charles Fuehrer, Scarsdale, N.Y.

[73] Assignee: Stoffel Seals Corporation, Tuckahoe, N.Y.

[21] Appl. No.: 623,209

[22] Filed: Dec. 6, 1990

[51] Int. Cl.[5] ..... A44C 3/00; A45F 5/02

[52] U.S. Cl. ..... 24/3 J; 24/3 R; 24/557; 40/1.5; 224/252

[58] Field of Search ..... 24/3 J, 3 R, 3 L, 327, 24/531, 542, 545, 557; 40/1.5, 1.6, 633; 224/221, 252

[56] References Cited

U.S. PATENT DOCUMENTS

| | | | |
|---|---|---|---|
| 2,360,815 | 10/1944 | Mungen | 40/1.5 |
| 3,237,326 | 3/1966 | Naffin | 40/1.5 |
| 3,810,321 | 5/1974 | Kiba | 40/1.5 |
| 4,277,863 | 7/1981 | Faneuf | 24/545 |
| 4,277,864 | 7/1981 | Orson, Sr. | 24/557 |
| 4,956,895 | 9/1990 | Hayasaka | 24/3 J |

*Primary Examiner*—Victor N. Sakran
*Attorney, Agent, or Firm*—Dowell & Dowell

[57] ABSTRACT

A reversibly mountable spring clip for use with badges, identification tags or pins which includes a clip which is selectively mounted in either of two directions within a pair of hinge posts which extend from the badge and which clip includes a clamping end which is resiliently biased with respect to the badge in order to engage an article therebetween.

18 Claims, 1 Drawing Sheet

CLIP ASSEMBLY FOR BADGES AND SIMILAR ARTICLES

BACKGROUND OF THE INVENTION

1. Field of the Invention

This invention is generally directed to spring clip assemblies and particularly to spring clips of the type referred to as "bulldog clips" and which are resiliently mounted or secured to such devices as identification tags, badges and the like which are designed to be worn on an article of clothing. The clip assemblies are more specifically structured so as to be reversibly mounted with respect to the identification tags or badges so as to provide a selective alignment of the tag or badge relative to an article of clothing so that the indicia displayed by the tag or badge may be selectively oriented. The invention is further directed to spring clips which may be selectively and alternatively mounted in either two separate positions between a pair of yieldable hinge posts associated with an identification tag, badge, pin or other device designed to be supported on an article of clothing.

2History of the Related Art

Conventional identification tags, badges and pins of a type which are designed to be worn on an article of clothing are provided with various securing devices by way of which such items are secured to the clothing. In some devices a pin and latch mechanism is provided which requires that the pin be inserted through the article of clothing and thereafter latched into position to support the tag. Unfortunately, such devices are not only awkward to secure to an article of clothing but are hazardous as the pins can cause puncture wounds, especially if handled by young children. Further, pin type attachment will also damage clothing by severing the material through which the pin has been inserted.

In order to overcome the shortcomings of the more conventional pin type mounts associated with identification tags, badges and the like, resilient spring clips have been designed to be secured to the rear surface of such tags or badges and which include one or more gripping jaws which may be utilized to engage a portion of an article of clothing therebetween. Generally, such clips are fixedly secured to the rear surface of the tag or badge and therefore the tag or badge may only be oriented in a particular direction when worn on an article of clothing.

SUMMARY OF THE INVENTION

This invention is directed to spring clip assemblies for mounting identification tags, badges, pins and similar indicia carrying devices to an article of clothing wherein the clip assemblies include a clip member which is selectively secured to the rear surface of a device by pivotally engaging a pair of pivot pins carried by the clip within openings in a pair of generally parallel hinge posts which extend from the rear surface of the device. In the preferred embodiment, the hinge posts are mounted in offset relationship with respect to the upper and lower edges of the device so that the clip may be selectively mounted in a reversible manner with respect to the hinge posts to thereby alter the orientation of the device with respect to the spring clip. Each spring clip assembly further incorporates a pair of ridges which are equally spaced on either side of the hinge posts and extend from the rear surface of the device and which selectively cooperate with a clamping ridge which extends from adjacent one end of the clip. The clip is resiliently biased by a spring which is positioned adjacent the rear portion of the clip and spaced intermediate the clip and the rear surface of the device.

The present invention is designed to allow selective alignment of the clip relative to the indicia display device and in this respect the clip is removably mounted with respect to the hinge posts. To facilitate the mounting of the clip with respect to the hinge posts the upper portion of the hinge posts are tapered outwardly with respect to one another thereby providing camming surfaces which are engaged by the pivot pins of the clip to thereby progressively force the posts outwardly relative to one another until the pins engage within the openings in the hinge posts. Each of the pivot pins may also be provided with a camming surface to further facilitate the engagement of the pins with the hinge posts.

It is the primary object of the present invention to provide a badge, identification tag, pin or similar device with a removably mounted spring clip which may be oriented in either of two directions with respect to the device so that the article may be worn in either of two selected orientations with respect to an article of clothing.

It is yet a further object of the present invention to provide an identification tag, badge or similar device with a spring mounting clip which ma be selectively mounted to the device in such a manner that the clip will provide a clamp adjacent the central portion of the device when in a first position but will provide a clamp adjacent an edge portion of the device when oriented in a second position thereby enabling an individual to selectively orientate the clip so as to facilitate the placement of the device so that the device, such as a badge or tag, may be mounted to different portions of wearing apparel, including a collar, pocket, lapel, belt or the like.

DESCRIPTION OF THE PREFERRED EMBODIMENT

Figure 1:
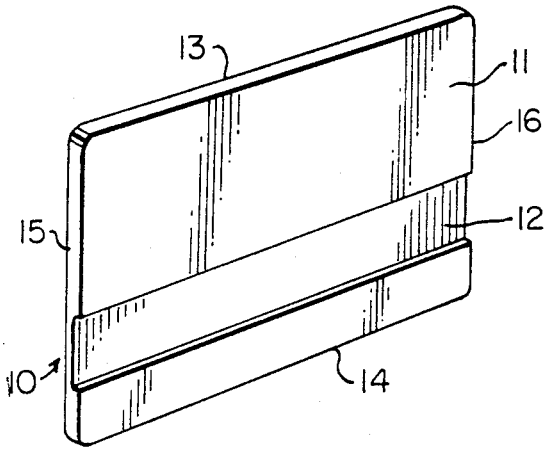
FIG. 1 is a first perspective view of a badge incorporating reversible spring clip of the present invention.

With continued reference to the drawings, a clip-on badge 10 is disclosed having a front surface 11 upon which various indicia, including name identification or advertising may be displayed and which may include an elongated slot 12 for insertion of an identification or advertising label, magnetic strip or other indicia depending upon the use of the badge. The badge further includes an upper edge 13, lower edge 14, side edges 15 and 16, and a rear surface 17. One of the benefits of the present invention is that the badge 10 may be worn so that either the edge 13 or edge 14 are oriented in an uppermost position, as is shown, respectively, in FIGS. 1 and 3 of the drawings. This means that the badge may be selectively oriented so that the indicia displayed thereon or material retained in slot 12 may be selectively oriented as desired. Although the invention will be described with respect to the use of a badge as shown in the drawing figures, it should be emphasized that the invention may be utilized in cooperation with identification tags, medals, pins and other types of display devices which are designed to be worn on an article of clothing or wearing apparel. Therefore, the use of the word "badge" will be synonymous with other display devices, both in the specification and in the claims.

With specific reference to FIGS. 2–6, the invention includes a clip assembly which includes a clip member 21 which is selectively mounted to a pair of hinge posts 22 which are integrally formed with the badge 10 and extend from the rear surface 17 thereof. The hinge posts are shown as being generally triangular in shape and are oriented in generally parallel spaced relationship with respect to one another at a distance which is slightly greater than the width W of the clip member 21. The hinge posts 22 are further provided in offset relationship so as to be more proximate to the upper edge 13 of the badge than to the lower edge 14 thereof, for purposes of which will be discussed in greater detail hereinafter. An opening 23 is provided through each of the posts 22 for purposes of receiving a pair of pivot pins 24 which are carried by flange members 25 extending outwardly relative to the lower surface 26 and adjacent each edge portion of the clip member 21.

Figure 4:
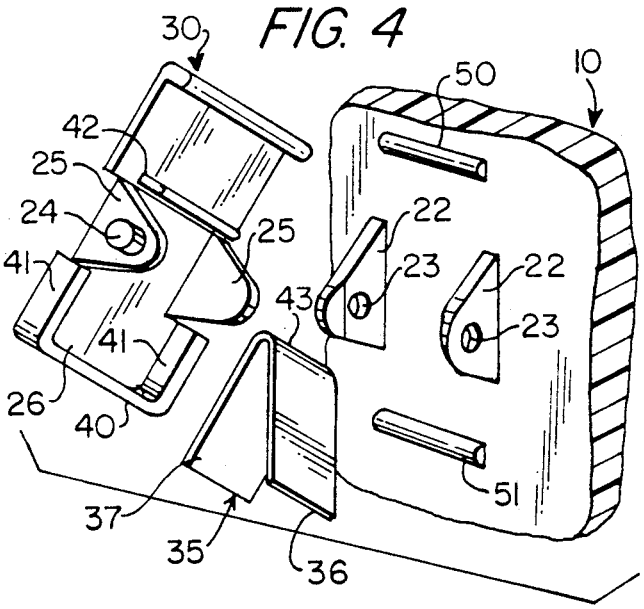
FIG. 4 is an enlarged assembly view of the spring clip assembly of the present invention.
Figure 6:
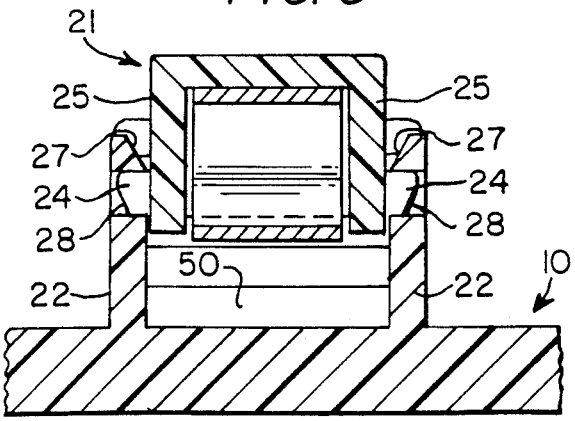
FIG. 6 is an enlarged partial cross-sectional view taken along lines 6—6 of FIG. 2.

As shown particularly in FIGS. 4 and 6, the uppermost portions of the hinge posts 22 include outwardly bevelled surfaces 27 which function as camming surfaces to allow the pivot pins 24 to be slidingly engaged therewith so that the pivot pins will continuously urge the posts 22 outwardly with respect to one another until the pivot pins 24 align with the openings 23 after which the yieldable posts will snap into a locking engagement retaining the pivot pins within the openings 23, as is shown in FIG. 6. In some embodiments of the invention, as shown in FIG. 6 of the drawings, a mating camming surface 28 is provided along each of the pivot pin 24 to further assist in camming the hinge posts 22 outwardly to permit the introduction of the clip member 21 into mounted association with the posts and also for facilitating the removal of the pivot pins 24 from the openings 23 to thereby permit a reorientation of the clip member 21 with respect to the posts.

The clip member 21 includes a first clamping end portion 30 defined by a depending rib 31 which extends generally the full width of the clip member. The clip member further includes a rear portion 32 having a ribbed upper surface 33 for purposes of providing a non-slip finger engaging area where pressure may be applied to pivot the clip 21 with respect to the badge 10.

Figure 5:
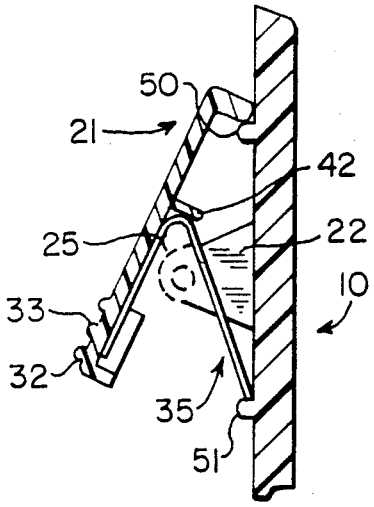
FIG. 5 is an enlarged cross-sectional view along lines 5—5 of FIG. 2.

In order to positively bias the clamping end 30 toward the rear surface 17 of the badge 10 a V-shaped spring element 35 is provided having a first leg portion 36 which is engagable against the rear surface of the badge intermediate the pivot posts 22. The other leg 37 of the spring is engagable with the lower surface 26 and adjacent the rear portion 32 of the clip 21 and extends intermediate the flanges 25 which support the pivot pins 24. As the legs 36 and 37 are opened outwardly toward the rear portion 32 of the clip member 21, the spring will tend to pivot the front portion 30 of the clip toward the rear surface 17 of the badge 10. The spring is retained in place by depending end and side walls 40 and 41 which serve to properly seat the leg portion 37 of the spring 35 therebetween. Any longitudinal movement of the spring 35 is prevented by the end wall 40 and an opposing stop member 42 which is molded to the lower surface of the clip member 21 along the first or front portion of the clip member and against which the intermediate end portion 43 of the spring member will abut as is shown in FIG. 5.

Figure 2:
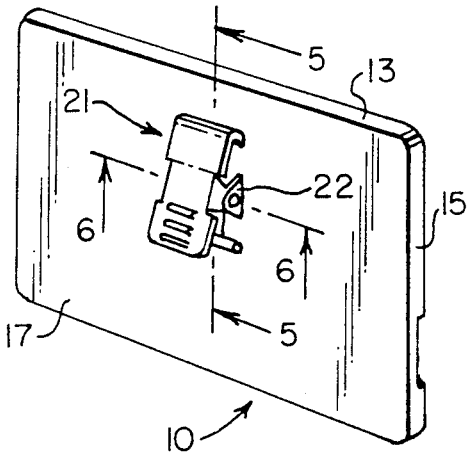
FIG. 2 is a rear perspective view showing the clip assembly as selectively mounted in a first position relative to the rear of the badge of FIG. 1.
Figure 3:
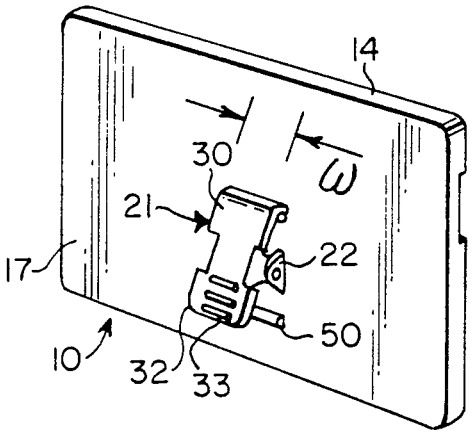
FIG. 3 is a rear perspective view showing the spring clip assembly of the present invention in second position with respect to the rear surface of the badge of FIG. 1 wherein the badge of FIG. 1 has been inverted.

To provide a secure clamping relationship between the clip member 21 and the badge 10 a pair of semicylindrical ridge elements 50 and 51 are molded to the rear surface 17 of the badge in generally equally spaced relationship on either side of the posts 22. The ridges are spaced so as to cooperate with the ridge 31 disposed along the front edge 30 of the clip member 21 to provide opposing gripping surfaces, as is shown in FIG. 5, wherein ridge 31 is located adjacent ridge 50. In those instances where the clip member 21 is mounted in a reversed relationship with respect to the badge, i.e. as shown in FIG. 3 of the drawings, the ridge 31 will be adjacent ridge 51. In this respect, a comparison should be made between the positioning of the clip 21 in FIGS. 2 and 3. In FIG. 2, the clip 21 is shown as being mounted within the posts 22 so that the clamping edge 31 is positioned adjacent the upper edge 13 of the badge 10. As opposed to mounting the clip in the position shown in FIG. 2, it is possible to reverse the clip by placing the clamping edge 31 in a position towards the center of the clip, as is shown in FIG. 3. In FIG. 3, the badge 10 is shown as being inverted so that the slot 12 is adjacent the upper portion of the badge. Due to the resiliency or yieldability of the posts 22, it is possible to remove or install the clip member 21 as is necessary to obtain a proper alignment of the clip relative to the badge 10. It is preferred that the clip 21 and badge 10 be made of plastic materials with the hinge posts 22 and clamp members 50 and 51 being integrally molded with the badge. The spring member 35 may be formed of a plastic material or metallic material as desired.

I claim:

1. A clip assembly for use with a badge, pin or similar article which is to be attached to an object and wherein the badge includes front and rear surfaces and upper and lower edges and wherein the front of the badge is designed to display indicia comprising, a pair of shaped hinge posts extending from the rear surface of the badge in generally parallel relationship with respect to one another, an opening in each of said hinge posts, said hinge posts being resiliently yieldable with respect to one another, a clip having first and second end portions, side edges and upper and lower surfaces, said clip including a pair of spaced generally parallel flange elements extending outwardly with respect to said lower surface thereof and intermediate said first and second end portions, a pivot pin carried by each of said flange elements and extending outwardly therefrom and in generally perpendicular relationship thereto, said pivot pins being selectively seated within said openings in said hinge posts, and spring means mounted between said second end portion of said clip and the rear surface of the badge for positively biasing said first end portion of said clip toward the rear surface of the badge whereby the object may be releasably clampingly engaged between said first portion of said clip and the rear surface of the badge.

2. The clip assembly of claim 1 in which each of said hinge posts includes an uppermost portion which extends outwardly beyond said openings therein, said uppermost portions tapering outwardly relative to one another to provide opposing cam surfaces which cooperate when engaged by said hinge pins to urge said hinge posts outwardly relative to one another until said pivot pins align with said openings.

3. The clip assembly of claim 2 in which each of said hinge pins includes a bevelled surface which is selectively engagable with said uppermost tapered portion of said hinge posts.

4. The clip assembly of claim 3 in which said clip includes a depending ridge extending from said lower surface thereof adjacent said first end portion, said ridge serving as a clamp to securely engage the object.

5. The clip assembly of claim 4 including first and second spaced ridges extending from said rear surface of the badge in generally equally spaced relationship on opposite sides of said hinge posts, said spaced ridges being aligned to cooperatively interact with said depending ridge of said clip to thereby clamp an object therebetween.

6. The clip assembly of claim 5 in which said spring means includes a first leg portion seated between said hinge posts and a second leg portion seated against said lower surface of said clip and abutment means carried by said clip and extending from said lower surface thereof for engaging said second leg portion to prevent the longitudinal movement of said spring means with respect to said clip.

7. The clip assembly of claim 6 including a plurality of ridges provided along said upper surface of said clip adjacent said second end portion thereof for providing a nonslip surface for manually engaging said clip.

8. The clip assembly of claim 7 in which said hinge posts are mounted closer in proximity to the upper edge of the badge then to the lower edge thereof.

9. The clip assembly of claim 8 in which said first spaced ridge which extends from said rear surface of the badge is positioned adjacent said upper edge thereof and said second spaced ridge is positioned generally centrally with respect to upper and lower edges.

10. The clip assembly of claim 1 in which said spring means includes a first leg portion seated between said hinge posts and a second leg portion seated against said lower surface of said clip and abutment means carried by said clip and extending from said lower surface thereof for engaging said second leg portion to prevent the longitudinal movement of said spring means with respect to said clip.

11. The clip assembly of claim 10 in which said hinge posts are mounted closer in proximity to the upper edge of the badge then to the lower edge thereof.

12. A clip assembly for use with a badge, pin or similar article which is to be attached to an object and wherein the badge includes front and rear surfaces and upper and lower edges and wherein the front of the badge is designed to display indicia comprising, a pair of shaped hinge posts extending from the rear surface of the badge in generally parallel relationship with respect to one another, an opening in each of said hinge posts, said hinge posts being resiliently yieldable with respect to one another, a clip having first and second end portions, side edges and upper and lower surfaces, said clip including a pair of spaced generally parallel flange elements extending outwardly with respect to said lower surface thereof and intermediate said first and second end portions, a pivot pin carried by each of said flange elements and extending outwardly therefrom and in generally perpendicular relationship thereto, said pivot pins being selectively seated within said openings in said hinge posts with said first end portion being oriented toward either said upper or lower edge of the badge, and spring means mounted between said second end portion of said clip and the rear surface of the badge for positively biasing said first end portion of said clip toward the rear surface of the badge whereby the object may be releasably clampingly engaged between said first portion of said clip and the rear surface of the badge.

13. The clip assembly of claim 12 in which said clip includes a depending ridge extending from said lower surface thereof adjacent said first end portion, said ridge serving as a clamp to securely engage the object.

14. The clip assembly of claim 13 including first and second spaced ridges extending from said rear surface of the badge in generally equally spaced relationship on opposite sides of said hinge posts, said spaced ridges being aligned to cooperatively interact with said depending ridge of said clip to thereby clamp an object therebetween.

15. The clip assembly of claim 14 in which said hinge posts are mounted closer in proximity to the upper edge of the badge then to the lower edge thereof.

16. The clip assembly of claim 15 in which said first spaced ridge which extends from said rear surface of the badge is positioned adjacent said upper edge thereof and said second spaced ridge is positioned generally centrally with respect to upper and lower edges.

17. The clip assembly of claim 16 in which each of said hinge posts includes an uppermost portion which extends outwardly beyond said openings therein, said uppermost portions tapering outwardly relative to one another to provide opposing cam surfaces which cooperate when engaged by said hinge pins to urge said hinge posts outwardly relative to one another until said pivot pins align with said openings.

18. The clip assembly of claim 17 in which each of said hinge pins includes a bevelled surface which is selectively engagable with said uppermost portion of said hinge posts.

* * * * *